US005566140A

United States Patent [19]

Kohata et al.

[11] Patent Number: 5,566,140

[45] Date of Patent: Oct. 15, 1996

[54] CLOCK MOVEMENT

[75] Inventors: Shigeru Kohata; Hiroyuki Hashizume, both of Tokyo, Japan

[73] Assignee: Seiko Clock Inc., Japan

[21] Appl. No.: 527,286

[22] Filed: Sep. 12, 1995

Related U.S. Application Data

[63] Continuation of Ser. No. 150,450, Nov. 10, 1993, abandoned.

[30] Foreign Application Priority Data

Nov. 10, 1992 [JP] Japan ..... 4-299999

[51] Int. Cl.[6] ..... G04B 19/02; G04C 11/02; G04C 9/00

[52] U.S. Cl. ..... 368/220; 368/47; 368/187

[58] Field of Search ..... 364/46, 47, 69–74, 364/76, 80, 185–187, 220, 223, 250, 256

[56] References Cited

U.S. PATENT DOCUMENTS 4,645,357 2/1987 Allgaier et al. ..... 368/187
5,231,612 7/1993 Allgaier et al. ..... 368/47

FOREIGN PATENT DOCUMENTS 0082821 6/1983 European Pat. Off. .
2226164 6/1990 United Kingdom .
2237902 5/1991 United Kingdom .

*Primary Examiner*—Vit W. Miska
*Attorney, Agent, or Firm*—Adams & Wilks

[57] ABSTRACT

A clock movement includes a circuit board, first and second motors, a minute wheel connected to the first motor by a first gear train and an hour wheel connected to the second motor by a second gear train. The first and second gear trains preferably extend in a first direction, and the first and second motors are respectively disposed on opposite sides of the first and second gear trains and extend in a second direction transverse to the first direction. A first detection device detects when the minute hand is in a predetermined reference position and a second detection device detects when the hour wheel is in a predetermined reference position. The first detection device includes a minute detection sensor mounted on the circuit board and having a first light-emitting device and a first light-receiving device. The second detection device includes an hour detection sensor mounted on the circuit board and having a second light-emitting device and a second light-receiving device. The clock movement has a simple construction and is easy to manufacture, is suited to mass-production and can be manufactured at low cost.

36 Claims, 2 Drawing Sheets

CLOCK MOVEMENT

This is a continuation of application Ser. No. 08/150,450 filed Nov. 10, 1993, now abandoned.

BACKGROUND OF THE INVENTION

This invention relates generally to a clock movement, and more particularly to a clock movement which can detect when an hour wheel and a minute wheel are in predetermined reference positions and correct the time displayed by hour and minute hands by a time zone time difference or by the error in the time displayed.

Examples of conventional clock movements of the kind to which this invention relates are described in Japanese Patent Publication No. 61-118683 and include those which detect when an hour hand, minute hand and second hand are displaying the time twelve o'clock, detect any difference (error) between the time at which this twelve o'clock time is displayed and the time at which a radio time signal or similar broadcast time signal for that hour is received, and, every twelve hours, correct any error in the time displayed by the clock.

In a first example disclosed in Japanese Patent Publication No. 61-118683, as shown in FIGS. 1–2 thereof, when openings in intermediate wheels and in an hour wheel and a minute wheel become aligned once per revolution of the hour wheel, i.e., once every 12 hours, light from a first light-emitting device mounted on a circuit board passes through the openings and is detected by a first light-receiving device mounted remote form the circuit board. The first light-receiving device then outputs a reference position signal denoting that the hour wheel and the minute wheel are in their reference positions. Similarly, once per revolution of the second hand, i.e., once per minute, when openings in an intermediate wheel and a second wheel become aligned, light from a second light-emitting device mounted on the circuit board passes through the openings and is detected by a second light-receiving device mounted remote from the circuit board, and the second light-receiving device then outputs a reference position signal denoting that the second wheel is in its reference position. When the two reference position signals are being outputted at the same time, it is judged that the time twelve o'clock is being displayed.

In a second example disclosed in Japanese Patent Publication No. 61-118683, as shown in FIG. 5 thereof, in order to enable both the light-emitting devices and the light-receiving devices to be mounted on the circuit board, the first and second light-receiving devices are disposed in the same positions on the circuit board as the first and second light-emitting devices are disposed in the above first example, and a single light-emitting device is also mounted on the circuit board. Two light-conducting bodies are used to guide light from the light-emitting device to the positions where the first and second light-receiving devices are disposed in the above first example.

However, with the first example referred to above, there is the problem that because the two light-receiving devices which face the two light-emitting devices are disposed remote from the circuit board, wires have to be provided to electrically connect both of these light-receiving devices to circuitry on the circuit board. The installation of these wires is an awkward and time-consuming task, whereby the clock movement cannot be easily mass-produced. In addition, misalignment between the light-emitting devices and the light-receiving devices can occur during assembly or during use, which makes it impossible for the reference positions to be precisely detected.

In the case of the second example referred to above, there is the problem that, in order to mount the single light-emitting device and the two light-receiving devices on the same circuit board, two light-conducting bodies have to be installed. The light-conducting bodies have to be disposed in a confined space, whereby the construction of the clock movement is made complicated and the cost of manufacture is increased.

SUMMARY OF THE INVENTION

The present invention was devised to solve the aforementioned kinds of problem associated with the conventional technology.

The main objects of the present invention are to provide a clock movement which has a simple construction and is easy to manufacture, which is suited to mass-production, and which can be manufactured at low cost.

To achieve these and other objects, the present invention comprises a clock movement having independent first and second motors capable of forward and reverse drive, a circuit board, a minute wheel connected to the first motor by a first gear train, and an hour wheel connected to the second motor by a second gear train. A first detection means detects when the minute hand is in a predetermined reference position, for example, the 0 minutes position. A second detection means detects when the hour wheel is in a predetermined reference position, for example, the 12 o'clock position.

The first detection means comprises a minute detection sensor mounted on the circuit board and having a first light-emitting device and a first light-receiving device, a first transparent portion through which light from the first light-emitting device passes and being mounted on an overlapping portion of either the minute wheel or a gear of the first gear train which overlaps with the minute wheel, and a reflector mounted on an overlapping portion of the other of the minute wheel or the gear and which becomes aligned with the first transparent portion only once per revolution of the minute wheel. The second detection means comprises an hour detection sensor mounted on the circuit board and having a second light-emitting device and a second light-receiving device, a second hour wheel which rotates in phase with the hour wheel, a second transparent portion through which light from the second light-emitting device passes and being mounted on an overlapping portion of either the second hour wheel or a gear of the second gear train which overlaps with the second hour wheel, and a reflector mounted on an overlapping portion of the other of the second hour wheel or the gear and which becomes aligned with the second transparent portion only once per revolution of the hour wheel. The first and second motors are disposed on opposite sides of the first and second gear trains.

By such an arrangement, the minute detection sensor of the first detection means, having a first light-emitting device and a first light-receiving device, and the hour detection sensor of the second detection means, having a second light-emitting device and a second light-receiving device, are both mounted on the same circuit board. Therefore all the wiring can be disposed on the circuit board, thereby simplifying manufacture and assembly and reducing the cost.

DETAILED DESCRIPTION OF THE INVENTION

A preferred embodiment of the present invention will now be described, with reference to the accompanying drawings.

Figure 1:
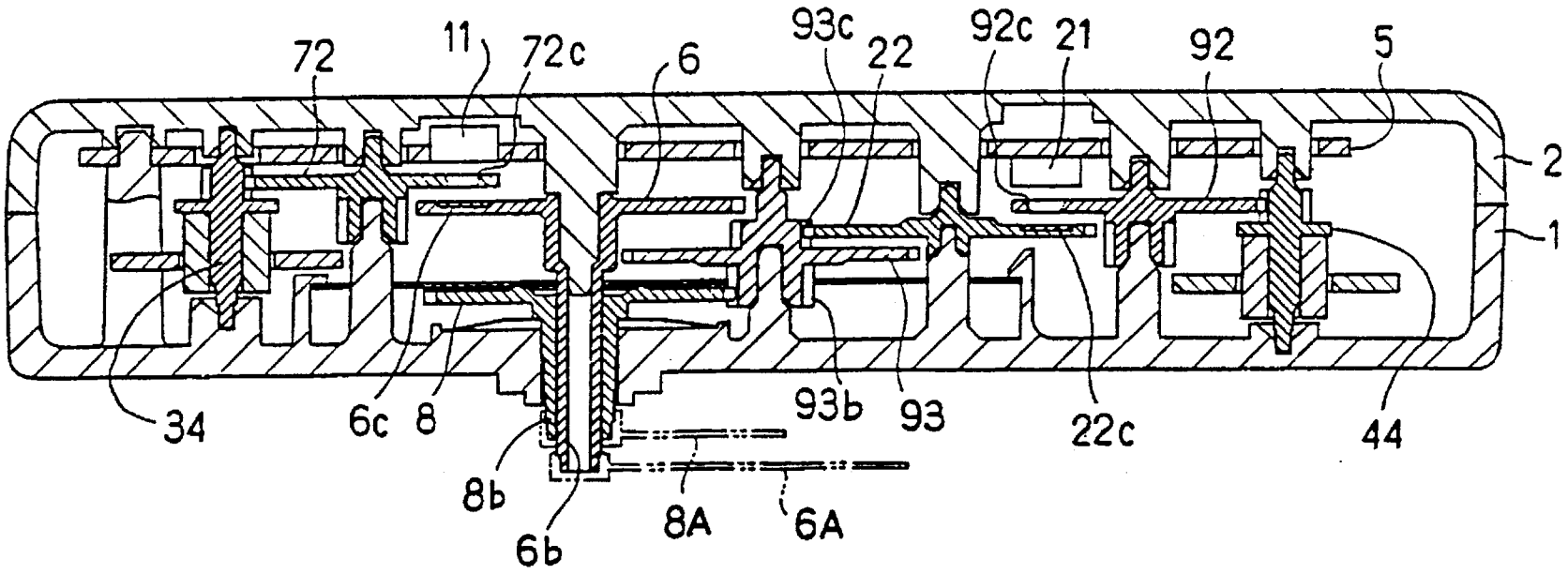
FIG. 1 is a cross-sectional view of a clock movement according to a preferred embodiment of the present invention.
Figure 2:
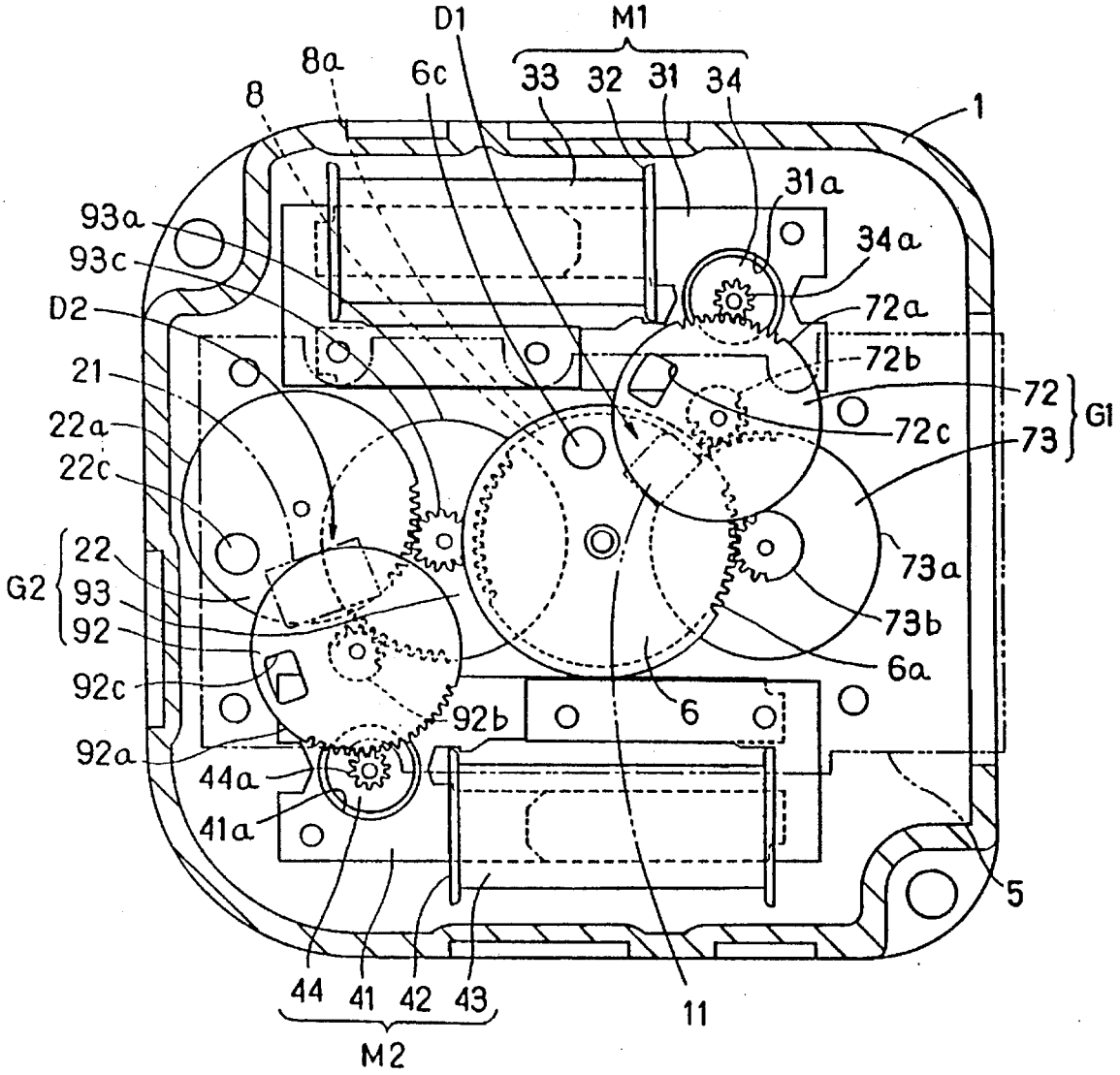
FIG. 2 is a plan view showing the clock movement of FIG. 1 with the lower case removed.

A clock movement according to a preferred embodiment of the present invention is shown in FIGS. 1 and 2. The clock movement has two independent motors M1 and M2 which respectively drive a minute hand 6A and an hour hand 8A. The clock movement can be used in a world clock in which the minute hand 6A and the hour hand 8A are used to display the present time in a designated city (for example, Tokyo) and, when a different city (for example, New York) in a different time zone from the currently designated city (Tokyo) is newly designated, the minute and hour hands 6A and 8A correct the currently displayed time by an amount equal to the time difference between the two cities to thereby display the present time in the newly designated city (New York). In order to correct the position of the hands, the minute wheel 6 and the hour wheel 8 each have a reference position, and the clock movement detects when the minute wheel 6 and the hour wheel 8 are in their respective reference positions.

As shown in FIGS. 1 and 2, the clock movement has a case comprised of a lower case 1 and an upper case 2. A pair of independently operable rotary motors M1 and M2 each capable of forward and reverse drive are mounted inside the case. The rotation of the two motors M1 and M2 is transmitted by a first gear train G1 and a second gear train G2 to a minute wheel 6 and an hour wheel 8, respectively.

A printed circuit board 5 is mounted in the case and supports the clock circuitry. A first detection means D1 for detecting when the minute wheel 6 is in its reference position (e.g., the 0 minutes position) and a second detection means D2 for detecting when the hour hand is in its reference position (e.g., the 12 o'clock position) are mounted in the case between the printed circuit board 5 and the first and second gear trains G1 and G2, respectively.

As shown in FIG. 2, the first motor M1 comprises a stator 31, a coil 33 wound around a coil bobbin 32 mounted on the stator 31, and a minute driving rotor 34 rotatably mounted in an opening 31*a* in the stator 31. The first gear train G1 includes a second wheel 72 having a large diameter tooth portion 72*a* which meshes with a pinion 34*a* of the minute driving rotor 34. A large diameter tooth portion 73*a* of a third wheel 73 meshes with a small diameter tooth portion 72*b*, coaxial with the large diameter tooth portion 72*a*, of the second wheel 72. A tooth portion 6*a* of the minute wheel 6 meshes with a small diameter tooth portion 73*b*, coaxial with the large diameter tooth portion 73*a*, of the third wheel 73.

By such a construction, the rotation of the minute driving rotor 34 of the first motor M1 is transmitted to the minute wheel 6 via the second wheel 72 and the third wheel 73 of the first gear train G1. As shown in FIG.1, a tubular portion 6*b* of the minute wheel 6 projects through the lower case 1 to the outside, and the minute hand 6A is mounted on the projecting end of the tubular portion 6*b*. In this manner, the first motor M1 rotationally drives the minute hand 6A in timed relation to indicate minute time.

Next, the second motor M2 and the construction of the second gear train G2, which transmits the drive of the motor M2 to the hour wheel 8, will be described. As shown in FIG. 2, the second motor M2 comprises a stator 41, a coil 43 wound around a coil bobbin 42 mounted on the stator 41, and an hour driving rotor 44 rotatably mounted in an opening 41*a* in the stator 41. The second gear train G2 includes a second wheel 92 having a large diameter tooth portion 92*a* which meshes with a pinion 44*a* of the hour driving rotor 44. A large diameter tooth portion 93*a* of a third wheel 93 meshes with a small diameter tooth portion 92*b*, coaxial with the large diameter tooth portion 92*a*, of the second wheel 92. A tooth portion 8*a* of the hour wheel 8 meshes with a small diameter tooth portion 93*b*, coaxial with the large diameter teeth portion 93*a*, of the third wheel 93. A tooth portion 22*a* of a second hour wheel 22, which has the same number of teeth as the tooth portion 8*a* of the hour wheel 8, meshes with another small diameter tooth portion 93*c* of the third wheel 93, whereby the second hour wheel 22 rotates in phase with the hour wheel 8.

By this construction, the rotation of the hour driving rotor 44 of the second motor M2 is transmitted to the hour wheel 8 via the second wheel 92 and the third wheel 93 of the second gear train G2. As shown in FIG. 1, a tubular portion 8*b* of the hour hand 8 is fitted coaxially over the tubular portion 6*b* of the hour hand 6 and passes through the lower case 1 to the outside, and the hour hand 8A is mounted on the projecting end of the tubular portion 8*b*. In this manner, the second motor M2 rotationally drives the hour hand 8A in timed relation to indicate hour time.

As shown in FIG. 2, the first motor M1 and the second motor M2 are respectively mounted on opposite sides of the first and second gear trains G1 and G2, As shown in FIGS. 1 and 2, the rotor 34 of the first motor M1 and the rotor 44 of the second motor M2 are rotatable about respective axes which are parallel to each other and which are parallel to the respective turning axes of the gears 72,73 of the first gear train G1 and the gears 22,92,93 of the second gear train G2. Moreover, as shown in FIG. 2, the stators 31,41 of the motors M1 and M2, respectively, extend along a longitudinal direction substantially parallel to the lower case 1 and the upper case 2. The first gear train G1 and the second gear train G2 are arranged between the lower case 1 and upper case 2 substantially in the longitudinal direction of the stators 31,41.

Next, the construction of the first detection means D1 for detecting when the minute wheel 6 is in its reference position (the 0 minutes position) will be described. As shown in FIGS. 1 and 2, a minute detection sensor 11 is mounted on the upper surface (the surface which faces upward in FIG. 1) of the circuit board 5. In this embodiment, the minute detection sensor 11 comprises a reflection-type photosensor having a first light-emitting device for emitting light and a first light-receiving device for receiving light. The first light-emitting device and first light-receiving device are mounted on the underside of the sensor 11 and face downward (the downward direction in FIG. 1) through the circuit board 5. A rectangular opening 72*c* is formed in a portion of the second wheel 72 which overlaps with the minute wheel 6. A circular reflector 6*c* is mounted on a portion of the minute wheel 6 which overlaps with the second wheel 72 and becomes aligned with the opening 72*c* only once per revolution of the minute wheel 6. The opening 72*c* is positioned relative to the reflector 6*c* so that the two become optically aligned only once per revolution of the minute wheel 6, which corresponds to the reference position of the minute wheel 6.

By such an arrangement, during operation of the clock movement, light emitted from the first light-emitting device of the minute detection sensor 11 is reflected into and received by the first light-receiving device only when the opening 72c in the second wheel 72 and the reflector 6c on the minute wheel 6 become aligned with each other. At the time of alignment, the minute wheel 6 is in its reference position (the 0 minutes position) and light emitted from the first light-emitting device of the minute detection sensor 11 passes through the opening 72c and is reflected by the reflector 6c and passes back through the opening 72c and into the first light-receiving device of the minute detection sensor 11, whereby the minute detection sensor 11 produces a reference position signal. To improve the accuracy of detection and avoid mis-detections, the second wheel 72 and the minute wheel 6 preferably have their faces painted black or are made of black plastic.

Next, the construction of the second detection means D2 for detecting when the hour wheel 8 is in its reference position (the 12 o'clock position) will be described. As shown in FIGS. 1 and 2, an hour detection sensor 21, which is also a reflection-type photosensor having a second light-emitting device and a second light-receiving device, is mounted on the lower surface (the surface which faces downward in FIG. 1) of the circuit board 5. The second light-emitting device and second light-receiving device are mounted on the underside of the sensor 21 and face downward (the downward direction in FIG. 1). A rectangular opening 92c is formed in a portion of the second wheel 92 which overlaps with the second hour wheel 22. A circular reflector 22c is mounted on a portion of the second hour wheel 22 which overlaps with the second wheel 92 and becomes aligned with the opening 92c only once per revolution of the second hour wheel 22.

During operation of the clock movement, light emitted from the second light-emitting device of the hour detection sensor 21 is reflected into and received by the second light-receiving device only when the opening 92c in the second wheel 92 and the reflector 22c on the second hour wheel 22 become aligned with each other. At the time of alignment, the hour wheel 8 is in its reference position (the 12 o'clock position) and light emitted from the second light-emitting device of the hour detection sensor 21 passes through the opening 92c and is reflected by the reflector 22c and passes back through the opening 92c and into the second light-receiving device of the hour detection sensor 21, whereby the hour detection sensor 21 produces a reference position signal. To enhance detection accuracy, the second wheel 92 and the second hour wheel 22 have their faces painted black or are made of black plastic.

The operation of the clock movement will now be described. For explanatory purposes, it will be assumed that the clock movement is incorporated in a world clock which can selectively display the time in different designated global regions, such as different time zones.

During ordinary clock running, a pulse signal is inputted to the coil 33 of the first motor M1 once every fifteen seconds, and the minute driving rotor 34 rotates through a fixed angle each time a pulse is inputted to the coil 33. The rotor rotation is transmitted by the first gear train G1 to the minute wheel 6, thereby rotating the minute wheel 6 through 1.5° every fifteen seconds, i.e., 360° (one revolution) per hour, in the forward or clockwise direction. A pulse signal is also inputted to the coil 43 of the second motor M2 once every three minutes, and the hour driving rotor 44 rotates through a fixed angle each time a pulse is inputted to the coil 43. The rotor rotation is transmitted by the second gear train G2 to the hour wheel 8, thereby rotating the hour wheel 8 through 1.5° every three minutes, i.e., 360° (one revolution) every twelve hours, in the forward or clockwise direction.

With the clock running in the ordinary state, when a city (for example, New York) in a different time zone from the city currently designated (for example, Tokyo) is newly designated, and the Tokyo time being displayed by the current ordinary running of the clock is to be corrected by an amount equal to the time difference between Tokyo and New York (thirteen hours) so that New York time is displayed, it is necessary that the minute wheel 6 and the hour wheel 8 be rotated rapidly to their respective reference positions. To achieve this, the ordinary clock running described above is temporarily interrupted and high frequency signals are inputted to the coils 33 and 43 of the first and second motors M1 and M2. These high frequency signals cause the minute wheel 6 and the hour wheel 8 to rotate much more quickly than they do during ordinary clock running.

When the opening 72c and the reflector 6c of the first detection means D1 become aligned with each other, as they do once and only once per revolution of the minute wheel 6, light emitted from the first light-emitting device of the minute detection sensor 11 passes through the opening 72c and is reflected by the reflector 6c, passes back through the opening 72c and into the firsts light-receiving device of the minute detection sensor 11, whereby the minute wheel 6-reference position signal is outputted from the minute detection sensor 11. Similarly, when the opening 92c and the reflector 22c of the second detection means D2 become aligned with each other, as they do once and only once per revolution of the hour wheel 8, light emitted from the second light-emitting device of the hour detection sensor 21 passes through the opening 92c and is reflected by the reflector 22c, passes back through the opening 92c and into the second light-receiving device of the hour detection sensor 21, whereby the hour wheel 8 reference position signal is outputted from the hour detection sensor 21.

When the minute wheel 6 reference position signal and the hour wheel 8 reference position signal are both being outputted at the same time, it is judged that the time exactly twelve o'clock is being displayed, whereupon the high frequency pulse signals to the coils 33 and 43 are stopped, and the minute hand 6A and the hour hand 8A stop in their exactly twelve o'clock positions. From this twelve o'clock state, in order to rotate the minute hand 6A and the hour hand 8A into positions in which they display the newly designated city (New York) time, the necessary number of pulse signals are inputted to the coils 33 and 43. As a result, the minute hand 6A and the hour hand 8A rotate rapidly until they display New York time, and ordinary clock running is then resumed.

According to this embodiment of the invention, because the minute detection sensor 11 and the hour detection sensor 12 are both mounted on the same printed circuit board 5, all the wiring can be disposed on the circuit board 5. This simplifies manufacture and assembly.

It is noted that although in this preferred embodiment the second hour wheel 22 and the hour wheel 8 have the same number of teeth, and the second hour wheel 22 and the hour wheel 8 both mesh with the third wheel 93, the invention is not limited to this construction, and different configurations can be adopted as long as the second hour wheel 22 rotates in phase with the hour wheel 8. Also, instead of forming the openings 72c and 92c as light-passing portions in the second wheels 72 and 92, transparent components can be mounted there.

In this preferred embodiment, the second wheel 72 is disposed between the minute wheel 6 and the printed circuit board 5. However, this configuration can be reversed and the minute wheel 6 disposed between the second wheel 72 and the printed circuit board 5. When this is done, a light-passing portion is provided in the minute wheel 6, and a reflector is mounted on the second wheel 72. Similarly, although in this preferred embodiment the second wheel 92 is disposed between the second hour wheel 22 and the printed circuit board 5, this configuration can be reversed and the second hour wheel 22 disposed between the second wheel 92 and the printed circuit board 5. When this is done, a light-passing portion is provided in the second hour wheel 22, and a reflector is mounted on the second wheel 92.

According to the preferred embodiment described above, the minute detection sensor of the first detection means, which comprises the first light-emitting device and the first light-receiving device, and the hour detection sensor of the second detection means, which comprises the second light-emitting device and the second light-receiving device, are both mounted on the same circuit board. As a result, all the wiring can be disposed on the circuit board. Therefore, the clock movement has a simple construction and is easy to manufacture, is suited to mass-production, and can be made at low cost.

We claim:

1. A clock movement, comprising:

a first motor capable of forward and reverse drive and having a first stator extending in a longitudinal direction;

a second motor capable of forward and reverse drive and having a second stator extending in the longitudinal direction of the first stator;

a circuit board;

a minute wheel connected to the first motor by a first gear train;

a first hour wheel connected to the second motor by a second gear train;

the first and second motors being respectively disposed on opposite sides of the first and second gear trains, and the first and second gear trains being arranged substantially in the longitudinal direction of the first and second stators;

first detection means for detecting when the minute wheel is in a predetermined reference position, the first detection means including a minute detection sensor mounted on the circuit board and having a first light-emitting device and a first light-receiving device, a first transparent portion through which light from the first light-emitting device passes and being mounted on one of the minute wheel or a gear of the first gear train which overlaps with the minute wheel, and a reflector mounted on the other of the minute wheel or the gear and positioned to become aligned with the first transparent portion only once per revolution of the minute wheel; and second detection means for detecting when the first hour wheel is in a predetermined reference position, the second detection means comprising an hour detection sensor mounted on the circuit board and having a second light-emitting device and a second light receiving device, a second hour wheel which rotates in phase with the first hour wheel, a second transparent portion through which light from the second light-emitting device passes and being mounted on one of the second hour wheel or a gear of the second gear train which overlaps with the second hour wheel, and a reflector mounted on the other of the second hour wheel or the gear and positioned to become aligned with the second transparent portion only once per revolution of the first hour wheel.

2. A clock movement according to claim 1; wherein the second hour wheel is disposed closer to the minute wheel than the first hour wheel.

3. A clock movement according to claim 2; wherein the minute detection sensor is disposed a first distance from the minute wheel, and the hour detection sensor is disposed a second distance from the second hour wheel equal to the first distance.

4. A clock movement according to claim 1; wherein the first and second gear trains each include a plurality of gears turnable about respective axes, and the first and second motors each include a rotor rotatable about an axis, the axes of the gears and the rotors all being parallel to one another.

5. A clock movement, comprising: a first gear train including a rotatable minute wheel; first drive means for rotationally driving the first gear train to rotate the minute wheel as a function of minute time, the first drive means having a first stator extending in a longitudinal direction; a second gear train including a rotatable first hour wheel; second drive means operable independently of the first drive means for rotationally driving the second gear train to rotate the first hour wheel as a function of hour time, the second drive means having a second stator extending in the longitudinal direction of the first stator, the first and second gear trains being arranged substantially in the longitudinal direction of the first and second stators; the first and second drive means being disposed respectively on opposite sides of the first and second gear trains; first detecting means for detecting when the minute wheel is in a predetermined reference position and producing a first reference position signal, the first detecting means including first light-emitting means for emitting light, first reflecting means for reflecting the emitted light, and first light-receiving means for receiving the reflected light and producing the first reference position signal, the first reflecting means being disposed on one of the gears of the first gear train at a position to reflect light emitted by the first light-emitting means onto the first light-receiving means once per revolution of the minute wheel; second detecting means for detecting when the first hour wheel is in a predetermined reference position and producing a second reference position signal, the second detecting means including second light-emitting means for emitting light, second reflecting means for reflecting the emitted light, and second light-receiving means for receiving the reflected light and producing the second reference position signal, the second reflecting means being disposed on one of the gears of the second gear train at a position to reflect light emitted by the second light-emitting means onto the second light-receiving means once per revolution of the first hour wheel; and a printed circuit board supporting thereon the first and second light-emitting means and the first and second light receiving means.

6. A clock movement according to claim 5; wherein at least two gears of the first gear train have overlapping portions, the first reflecting means being disposed on one of the overlapping portions, and the other overlapping portion having a first transparent portion through which the emitted light passes to the first reflecting means and through which the reflected light passes to the first light-receiving means.

7. A clock movement according to claim 6; wherein at least two gears of the second gear train have overlapping portions, the second reflecting means being disposed on one of the overlapping portions, and the other overlapping portion having a second transparent portion through which the emitted light passes to the second reflecting means and through which the reflected light passes to the second light receiving means.

8. A clock movement according to claim 6; wherein one of the two gears of the first gear train having overlapping portions comprises the minute wheel.

9. A clock movement according to claim 8; wherein the first reflecting means is disposed on the overlapping portion of the minute wheel.

10. A clock movement according to claim 5; wherein at least two gears of the second gear train have overlapping portions, the second reflecting means being disposed on one of the overlapping portions, and the other overlapping portion having a second transparent portion through which the emitted light passes to the second reflecting means and through which the reflected light passes to the second light receiving means.

11. A clock movement according to claim 10; wherein one of the two gears of the second gear train having overlapping portions comprises a second hour wheel rotatable in phase with the first hour wheel.

12. A clock movement according to claim 11; wherein the second reflecting means is disposed on the overlapping portion of the another hour wheel.

13. A clock movement according to claim 5; wherein the first and second gear trains each include a plurality of gears turnable about respective axes, and the first and second drive means each include a rotor rotatable about an axis, the axes of the gears and the rotors all being parallel to one another.

14. A clock movement according to claim 8; wherein the first light-emitting means and the first light-receiving means are respectively disposed a first distance from the minute wheel, and the second light-emitting means and second light-receiving means are respectively disposed a second distance from the first-mentioned hour wheel equal to the first distance.

15. A clock movement according to claim 5; wherein the first and second drive means each comprises a bi-directional rotary motor.

16. A clock movement according to claim 11; wherein the second hour wheel is disposed closer to the minute wheel than the first hour wheel.

17. A clock movement according to claim 16; wherein the first light-emitting means and the first light-receiving means are respectively disposed a first distance from the minute wheel, and the second light-emitting means and second light-receiving means are respectively disposed a second distance from the second hour wheel equal to the first distance.

18. A clock movement, comprising: a first gear train including a rotatable minute wheel; first drive means for rotationally driving the first gear train to rotate the minute wheel as a function of minute time, the first drive means having a first stator extending in a longitudinal direction; a second gear train including a rotatable hour wheel; second drive means operable independently of the first drive means for rotationally driving the second gear train to rotate the hour wheel as a function of hour time, the second drive means having a second stator extending in the longitudinal direction of the first stator; the first and second drive means being disposed respectively on opposite sides of the first and second gear trains, the first and second gear trains being arranged substantially in the longitudinal direction of the first and second stators; first detecting means for detecting when the minute wheel is in a predetermined reference position and producing a first reference position signal, the first detecting means including first light-emitting means for emitting light and first light-receiving means for receiving the emitted light and producing the first reference position signal; second detecting means for detecting when the hour wheel is in a predetermined reference position and producing a second reference position signal, the second detecting means including second light-emitting means for emitting light and second light-receiving means for receiving the emitted light and producing the second reference position signal; and a printed circuit board supporting thereon the first and second light-emitting means and the first and second light-receiving means.

19. A clock movement, comprising: independent first and second motors capable of forward and reverse drive; a circuit board; a minute wheel connected to the first motor by a first gear train; a first hour wheel connected to the second motor by a second gear train; first detection means for detecting when the minute wheel is in a predetermined reference position, the first detection means including a minute detection sensor mounted on the circuit board and having a first light-emitting device and a first light-receiving device, a first transparent portion through which light from the first light-emitting device passes and being mounted on one of the minute wheel or a gear of the first gear train which overlaps with the minute wheel, and a reflector mounted on the other of the minute wheel or the gear and positioned to become aligned with the first transparent portion only once per revolution of the minute wheel; and second detection means for detecting when the first hour wheel is in a predetermined reference position, the second detection means comprising an hour detection sensor mounted on the circuit board and having a second light-emitting device and a second light receiving device, a second hour wheel which rotates in phase with the first hour wheel, the second hour wheel being disposed closer to the minute wheel than the first hour wheel; a second transparent portion through which light from the second light-emitting device passes and being mounted on one of the second hour wheel or a gear of the second gear train which overlaps with the second hour wheel, and a reflector mounted on the other of the second hour wheel or the gear and positioned to become aligned with the second transparent portion only once per revolution of the first hour wheel; wherein the minute detection sensor is disposed a first distance from the minute wheel, and the hour detection sensor is disposed a second distance from the second hour wheel equal to the first distance.

20. A clock movement according to claim 19; further comprising a circuit board, the minute wheel being closer to the circuit board than the second hour wheel.

21. A clock movement according to claim 20; wherein the minute wheel comprises a tubular portion extending in a first direction, the minute detection sensor extends in a second direction opposite the first direction, and the hour detection sensor extends in the first direction.

22. A clock movement, comprising: independent first and second motors capable of forward and reverse drive; a circuit board; a minute wheel connected to the first motor by a first gear train; a first hour wheel connected to the second motor by a second gear train, the first and second motors being respectively disposed on opposite sides of the first and second gear trains; first detection means for detecting when the minute wheel is in a predetermined reference position, the first detection means including a minute detection sensor mounted on the circuit board and having a first light-emitting device and a first light-receiving device, a first transparent portion through which light from the first light-emitting device passes and being mounted on one of the minute wheel or a gear of the first gear train which overlaps with the minute wheel, and a reflector mounted on the other of the minute wheel or the gear and positioned to become aligned with the first transparent portion only once per revolution of the minute wheel; and second detection means for detecting when the first hour wheel is in a predetermined reference position, the second detection means comprising an hour detection sensor mounted on the circuit board and having a second light-emitting device and a second light receiving device, a second hour wheel which rotates in phase with the first hour wheel, a second transparent portion through which light from the second light-emitting device passes and being mounted on one of the second hour wheel or a gear of the second gear train which overlaps with the second hour wheel, and a reflector mounted on the other of the second hour wheel or the gear and positioned to become aligned with the second transparent portion only once per revolution of the first hour wheel; wherein the minute detection sensor is disposed a first distance from the minute wheel, and the hour detection sensor is disposed a second distance from the second hour wheel equal to the first distance.

23. A clock movement according to claim 22; wherein the second hour wheel is disposed closer to the minute wheel than the first hour wheel.

24. A clock movement according to claim 23; wherein the minute wheel is closer to the circuit board than the second hour wheel.

25. A clock movement according to claim 24; wherein the minute wheel comprises a tubular portion extending in a first direction, the minute detection sensor extends in a second direction opposite the first direction, and the hour detection sensor extends in the first direction.

26. A clock movement, comprising: a first gear train including a rotatable minute wheel; first drive means for rotationally driving the first gear train to rotate the minute wheel as a function of minute time; a second gear train including a rotatable first hour wheel; second drive means operable independently of the first drive means for rotationally driving the second gear train to rotate the first hour wheel as a function of hour time; the first and second drive means being disposed respectively on opposite sides of the first and second gear trains; first detecting means for detecting when the minute wheel is in a predetermined reference position and producing a first reference position signal, the first detecting means including first light-emitting means for emitting light, first reflecting means for reflecting the emitted light, and first light-receiving means for receiving the reflected light and producing the first reference position signal, the first reflecting means being disposed on one of the gears of the first gear train at a position to reflect light emitted by the first light-emitting means onto the first light-receiving means once per revolution of the minute wheel; second detecting means for detecting when the hour wheel is in a predetermined reference position and producing a second reference position signal, the second detecting means including second light-emitting means for emitting light, second reflecting means for reflecting the emitted light, and second light-receiving means for receiving the reflected light and producing the second reference position signal, the second reflecting means being disposed on one of the gears of the second gear train at a position to reflect light emitted by the second light-emitting means onto the second light-receiving means once per revolution of the first hour wheel; and a printed circuit board supporting thereon the first and second light-emitting means and the first and second light receiving means; wherein the first light-emitting means and the first light-receiving means are respectively disposed a first distance from the minute wheel, and the second light-emitting means and second light-receiving means are respectively disposed a second distance from the first hour wheel equal to the first distance.

27. A clock movement according to claim 26; wherein at least two gears of the second gear train have overlapping portions, the second reflecting means being disposed on one of the overlapping portions, and the other overlapping portion having a second transparent portion through which the emitted light passes to the second reflecting means and through which the reflected light passes to the second light receiving means.

28. A clock movement according to claim 27; wherein one of the two gears of the second gear train having overlapping portions comprises a second hour wheel rotatable in phase with the first hour wheel.

29. A clock movement according to claim 28; wherein the second hour wheel is disposed closer to the minute wheel than the first hour wheel.

30. A clock movement according to claim 29; wherein the minute wheel is closer to the circuit board than the second hour wheel.

31. A clock movement according to claim 30; wherein the minute wheel comprises a tubular portion extending in a first direction, the minute detection sensor extends in a second direction opposite the first direction, and the hour detection sensor extends in the first direction.

32. A clock movement according to claim 26; wherein at least two gears of the first gear train have overlapping portions, the first reflecting means being disposed on one of the overlapping portions, and the other overlapping portion having a first transparent portion through which the emitted light passes to the first reflecting means and through which the reflected light passes to the first light-receiving means.

33. A clock movement according to claim 32; wherein one of the two gears of the first gear train having overlapping portions comprises the minute wheel.

34. A clock movement according to claim 33; wherein the second gear train comprises a second hour wheel rotatable in phase with the first hour wheel.

35. A clock movement according to claim 34; wherein the minute wheel is closer to the circuit board than the second hour wheel.

36. A clock movement according to claim 35; wherein the minute wheel comprises a tubular portion extending in a first direction, the minute detection sensor extends in a second direction opposite the first direction, and the hour detection sensor extends in the first direction.

* * * * *